United States Patent [19]

Mitcham et al.

[11] Patent Number: 5,030,025

[45] Date of Patent: Jul. 9, 1991

[54] PRINTER HAVING DISENGAGEABLE IDLER ROLLER ASSEMBLY

[75] Inventors: Larry D. Mitcham, Temple; James S. Durkee, Belton, both of Tex.

[73] Assignee: Texas Instruments Incorporated, Dallas, Tex.

[21] Appl. No.: 305,251

[22] Filed: Feb. 1, 1989

[51] Int. Cl.[5] ..... B41J 15/04

[52] U.S. Cl. ..... 400/636; 400/616.1

[58] Field of Search ..... 400/636, 637.1, 616, 400/616.1

[56] References Cited

U.S. PATENT DOCUMENTS

| | | | |
|---|---|---|---|
| 3,722,655 | 3/1973 | Singer | 400/636 |
| 4,269,522 | 5/1981 | Levinson et al. | 400/616.1 |
| 4,507,003 | 3/1985 | Wincent | 400/636 |
| 4,619,538 | 10/1986 | Patterson | 400/621 |
| 4,641,830 | 2/1987 | Okuda et al. | 400/637.1 |
| 4,878,772 | 11/1989 | Fukumoto et al. | 400/120 |
| 4,934,847 | 6/1990 | Shiozaki et al. | 400/234 |

FOREIGN PATENT DOCUMENTS

| | | | |
|---|---|---|---|
| 0263079 | 11/1987 | Japan | 400/636 |

*Primary Examiner*—Edgar S. Burr
*Assistant Examiner*—John S. Hilten
*Attorney, Agent, or Firm*—L. Joy Griebenow; James T. Comfort; Melvin Sharp

[57] ABSTRACT

In accordance with the preferred embodiment of the invention, a cam-operated idler roller assembly maintains tension on a computer printer generated form as it advances through the print station of a computer printer. This invention provides a nip station that disengages on a print medium reversal to allow the form to be run in a reverse direction through the print station by means of a cam design that disengages the idler roller assembly from the drive roller. The cam design further allows the idler roller assembly to reengage on forward print media movement to reestablish tension in the printing station.

30 Claims, 4 Drawing Sheets

PRINTER HAVING DISENGAGEABLE IDLER ROLLER ASSEMBLY

BACKGROUND OF THE INVENTION

1. Field of the Invention

This invention relates to paper feed for computer printers and more specifically to an apparatus for maintaining proper tension on a computer printer generated form as it advances through a print station by the use of cams to disengage the idler roller assembly.

2. Description of the Related Art

The majority of computer printers require printer paper feed tension for quality printing results. In printers such as Texas Instruments Model 885, printer paper feed tension for sprocket fed print media, such as perforated continuous paper forms, is performed by the coordinated action of a nip station and a paper tractor feed. The nip station surface is where the idler rollers and drive roller abut. Because the idler and drive rollers rotate in opposite directions against the print media sandwiched between, they assist the print media through the print station. The idler roller is held against the drive roller by the use of springs. The print station generally comprises either a printhead-ribbon-platten or laser-toner ink configuration and is capable of printing images or characters on the print media. The continuous paper leaving the paper tractor feed threads past the print station and between the rollers at the nip station, emerging at a tear-off bar.

During forward print media movement, the primary continuous movement is due to the paper tractor feed. Tension is maintained above the print station by the nip station which typically rotates at a speed slightly faster than the paper tractor feed.

Unfortunately, during reverse print media movement, the nip station continues to rotate faster than the paper tractor feed sprocket teeth can move the print media. As a result, print media quickly accumulates, thus creating a print media bulge between the nip station and the print station/paper tractor feed. Such form bulges often cause the form to jam.

The most common device employed to attempt to solve this problem involves using an overrunning one-way clutch on the drive shaft. The clutch drives the drive shaft only in the forward direction and disengages the drive shaft when going backward. This method has several disadvantages. Due to the viscosity of the grease in the clutches, and the mechanics of the device, not enough drag occurs to prevent paper bulges and print quality losses. Furthermore, a precision shaft is required to be used with these clutches. Both the precision shaft and the clutches are quite expensive. Yet another disadvantage involves the need for the shaft assembly to make at least a 15–20 angular minute rotation before the drive reactivates.

Another attempt to solve the problem involves putting a clutch on the idler shaft. The idler rollers are mounted directly to the shaft and the clutch disengages the idler shaft when going backward. This method locks up the idler shaft to the frame during reverse motion and thereby drags the paper across the stationary rollers. Another disadvantage to this method is that the entire shaft and rollers must be accelerated from stand still to printing speed which degrades the print quality.

Some computers embody an improvement over the above devices. Such computers employ an electronic solenoid to separate the idler and drive rollers. Nevertheless the solenoid has several disadvantages. Not only is it expensive, it takes up extra space and requires additional power for the printing mechanism. Furthermore, its operation is noisy.

SUMMARY OF THE INVENTION

In view of the above problems, the primary purpose of the present invention is to provide an apparatus for mechanically disengaging or separating the idler and drive rollers to permit unassisted passage of the print media during reverse print media movement, while permitting normal positioning of the nip station during forward print media movement.

Another object of the present is to enable a printer to print on all lines of each page of the continuous print media without waste of all or part of an additional form, or jamming due to form misfeed.

Additional objects of the present invention are to provide an inexpensive apparatus for separating the nip station rollers without the use of wires, electronics, software, overrunning clutches or solenoids. Such apparatus saves valuable printer space, is quiet in operation and requires no additional power to operate.

In accordance with the preferred embodiment of the invention, a cam-operated idler roller assembly maintains tension on a computer printer generated form as it advances through the print station of a bottom tractor feed printer. This design allows the form to be run in a reverse direction through the print station by means of a cam design that disengages the idler roller assembly from the drive roller. This application is especially useful in printers with a short tear-off or graphics capability where reverse travel of forms or other continuously fed print media is necessary.

As the paper tractor feed assembly moves the print media or form through and past the print station, an idler roller/tear-off bar assembly maintains constant pressure on the form against the drive roller. An overdrive built into the drive roller provides a constant tension on the form as it moves through the tear-off slot. Two cams on the same shaft as the idler rollers do not contact the drive roller during forward print media movement. During reverse print media movement (e.g., when the top of a continuous form moves back to the print station after being separated), the idler rollers' friction on the idler roller shaft turns the shaft to make the cams' lobes come in contact with the drive roller shaft. The drive roller shaft then turns the cams which in turn moves the spring-loaded idler roller assembly away from the drive roller and continuous form. An arm or tab on at least one of the cams engages a stop device on the tear bar which prevents the idler roller/-tear bar assembly from further outward movement. When the form commences forward movement again, the drive roller shaft turns the cams thus allowing the idler roller assembly to return to its original position against the drive roller, and thereby maintain tension on the continuous form. These and other features and advantages of the invention will be apparent to those skilled in the art from the following detailed description of a preferred embodiment, taken together with the accompanying drawings, in which:

DETAILED DESCRIPTION OF A PREFERRED EMBODIMENT

Figure 1:
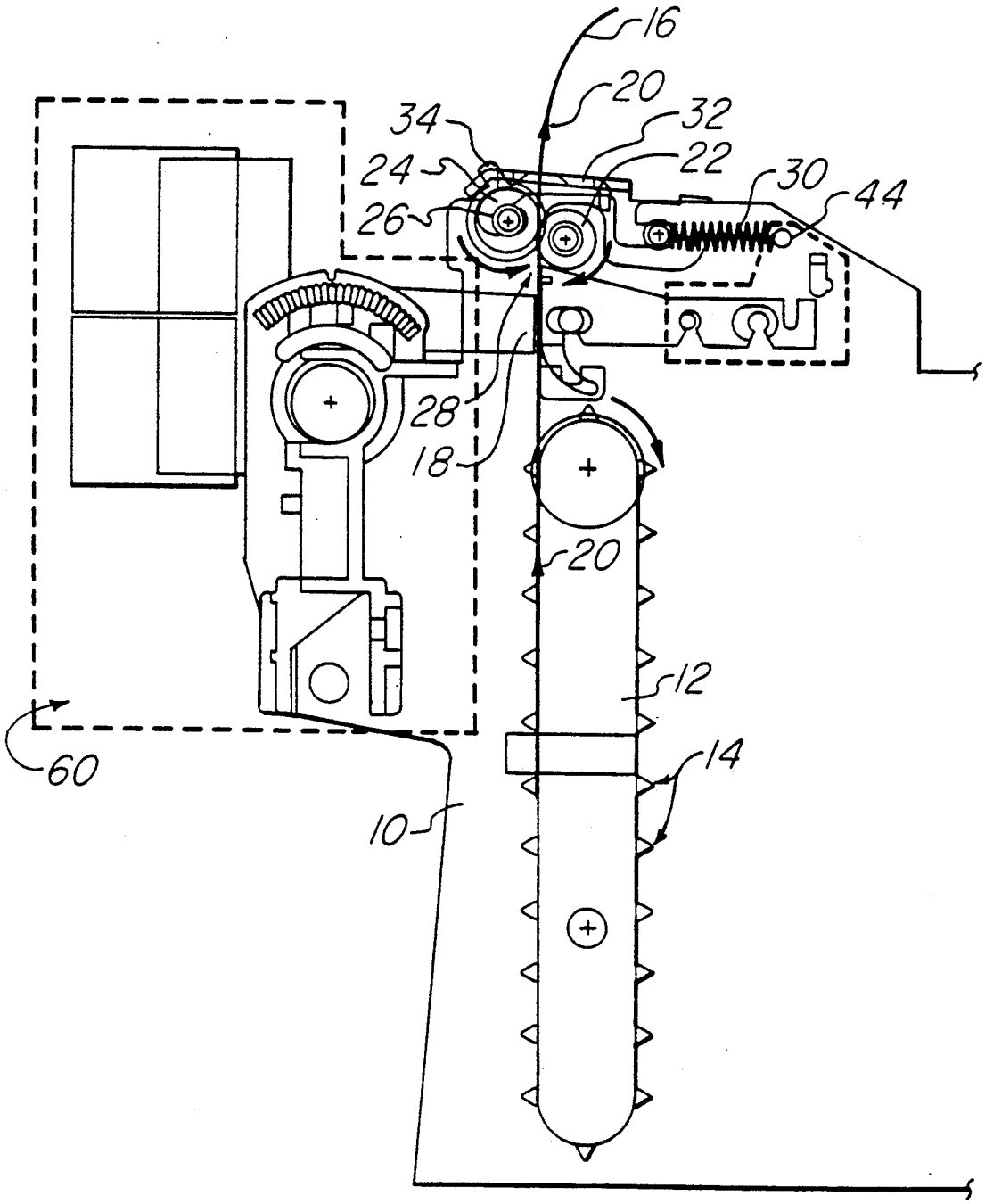
FIG. 1 is a sectional side view of a printing mechanism for printing on sprocket fed print media embodying the present invention, showing the nip station in its closed configuration.

FIG. 1 of the drawings shows a side view of an entire printer mechanism 10 operating in the forward print media direction. Paper tractor feed 12, with sprocket teeth 14, is shown feeding continuous paper form 16 past printer station 18 in the direction of arrows 20, and between drive roller 22 and idler rollers 24. Area 60, enclosed by dashed lines, includes a printhead and printhead carriage for illustration purposes only. As seen in FIG. 1, idler rollers 24 are located on idler shaft 26 and rotate in a counter-clockwise direction as continuous paper form 16 moves in a forward direction. At the same time drive roller 22 rotates in a clockwise direction, opposite to idler rollers 24. The tension between drive roller 22 and idler rollers 24 is maintained by extension springs 30. Continuous paper form 16 emerges from between drive roller 22 and idler rollers 24 and through a slot in tear bar 32. Tear bar 32 is the support frame for the idler roller shaft 26 containing idler rollers 24.

Extension springs 30 are connected at one end to the tear bar 32 and at the other end to a mounting structure 44. Although only one spring 30 is seen in FIG. 1, there are two, one at each end of the tear bar. The mounting structure 44 provides an anchoring for spring 30 and can be an inside surface of the printer frame, a post, the top of the printer, etc. The mounting structure 44 should be proximately located to rollers 22, 24; close enough for the particular type of spring 30 being used to be feasibly connected at its other end to one end of tear bar 32.

Figure 6:
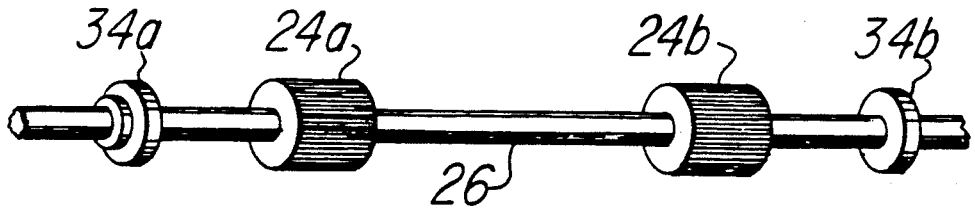
FIG. 6 is a sectional view of the preferred embodiment of the present invention depicting the present invention positioned at both ends of the idler roller shaft.

During normal printing, or forward print media movement, drive roller 22 and idler rollers 24 will apply light tension on continuous paper form 16 because rollers 22, 24 are rotating at a slightly greater speed than paper tractor feed 12. The preferred embodiment of the present invention makes use of inexpensive molded elastomeric cams 34 located on each end of idler shaft 26. Looking briefly at FIG. 6, cams 34*a,b* are shown located on each end of idler shaft 26 with idler rollers 24*a,b*. Returning to FIG. 1, because cams 34 clear the drive roller shaft 46, they do not affect the operation of nip station 28 during normal printing.

Figure 2:
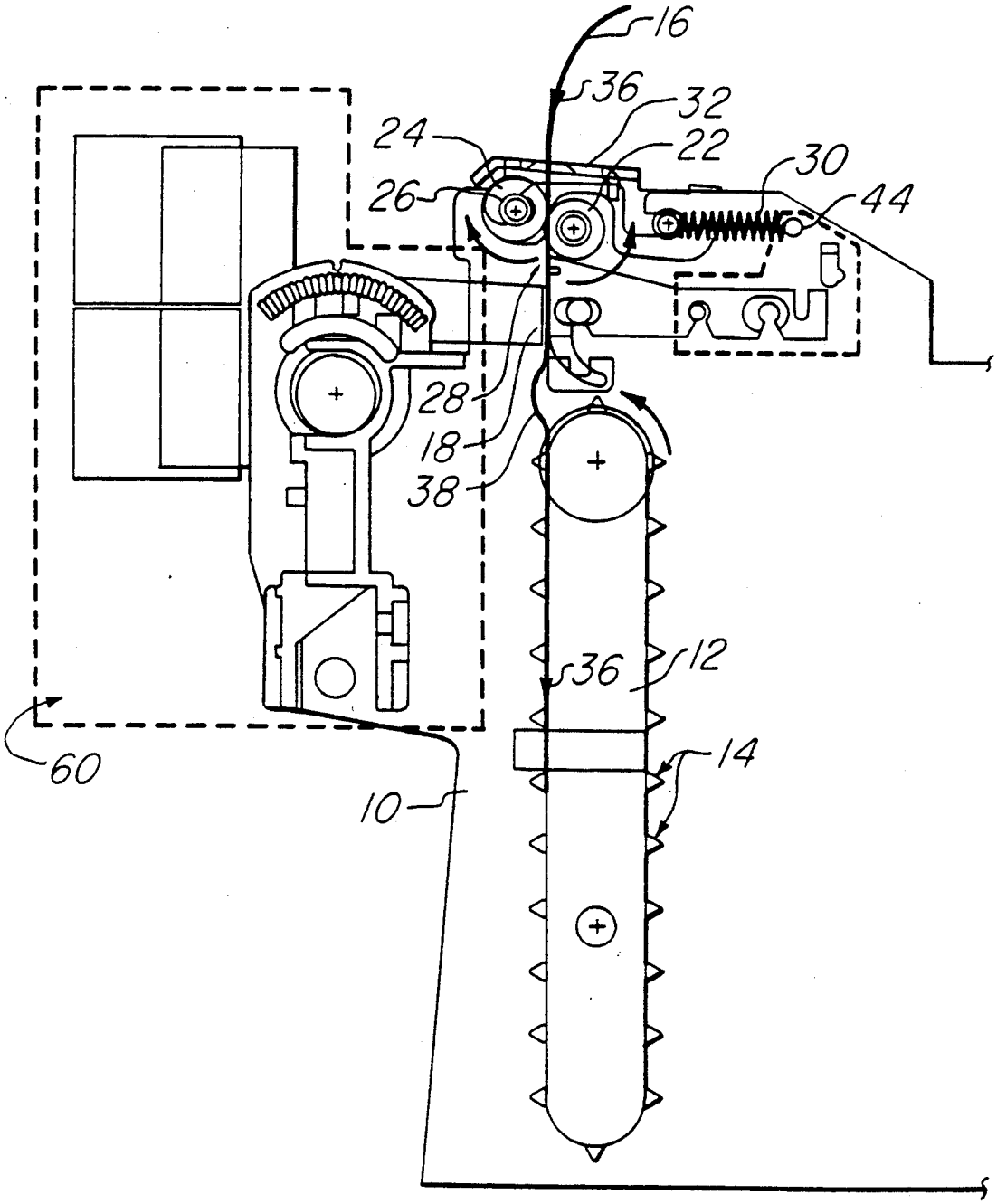
FIG. 2 is a sectional side view of a bottom feed tractor printer without the present invention, operating in reverse print media direction.

The need for the present invention is demonstrated with FIG. 2 which shows the print mechanism 10, without the present invention, operating in the reverse print media direction. Paper tractor feed 12 is now pulling continuous paper form 16 past printer station 18 in the direction of arrows 36. Again, area 60, enclosed by dashed lines, includes a printhead and printhead carriage for illustration purposes only. As seen in FIG. 2, drive roller 22 is rotating in a counter-clockwise direction and idler rollers 24 are rotating in the clockwise direction. If drive roller 22 and idler rollers 24 are left engaged as in the closed configuration of FIG. 1, a "bubble" or bulge 38 in continuous paper form 16 will be generated below or around print station 18 because rollers 22, 24 are operating at a velocity greater than paper tractor feed 12. Such a bulge 38 hinders printer activity and often causes a jam. Furthermore, since reverse print media movement is required to print on all possible lines of continuous paper form 16, it is very important to overcome the effect of nip station 28.

Figure 3:
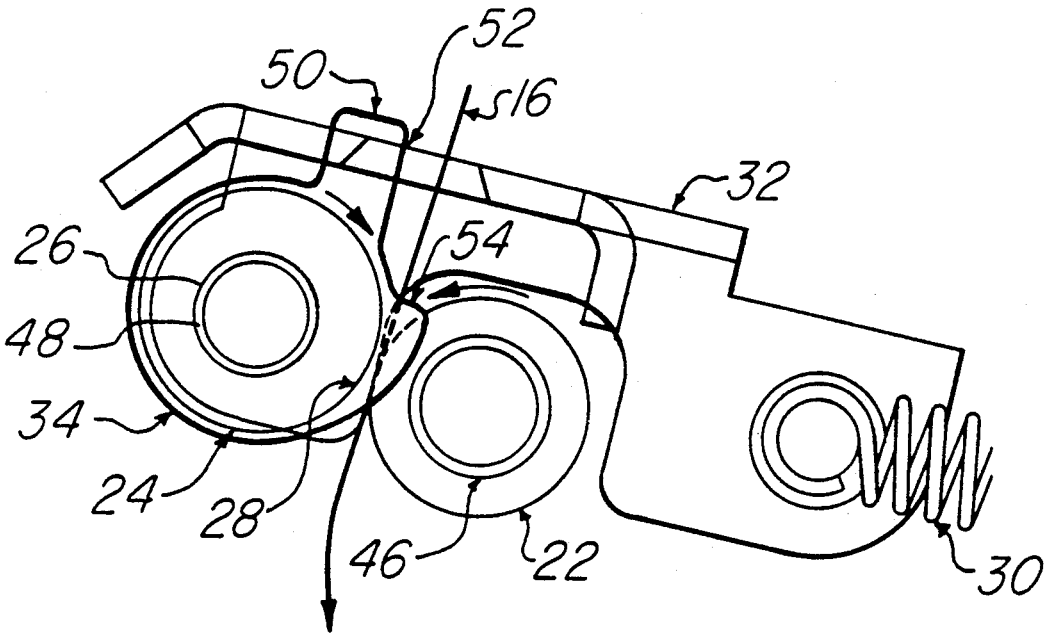
FIG. 3 is a close-up sectional side view of the preferred embodiment of the present invention with the idler roller assembly disengaged from the drive roller.

To overcome these problems, FIG. 3 shows a close up view of the preferred embodiment of the present invention shown in FIG. 1, except that FIG. 3 demonstrates reverse print media movement. This movement makes idler rollers 24 rotate backwards and idler rollers' 24 movement creates friction on idler shaft 26 which turns the idler shaft 26. Furthermore, the rotation of the idler shaft 26 causes the elastomeric cams 34 to be rotated about idler shaft bearing 48 until their cam lobes 54 engage the curved surface of drive roller shaft 46. (Although only one cam 34 is seen in FIG. 3, there are two, one at each end of idler shaft 26.) Further rotation causes cams 34 to push the idler shaft 26, along with idler rollers 24, away from drive roller 22 and continuous paper form 16. This is accomplished by cam tab 50 rotating along tear bar tab slot 42 located in tear bar 32. Cam tab 50, on at least one of the cams 34, engages at least one stop device 52 on the tear bar 32 which prevents the idler shaft 26 and idler rollers 34 from further outward movement. Stop device 52 may be a protruding portion of tear bar 32 or may be a protruding bolt, an indent in the frame of tear bar 32, or, as in the preferred embodiment, a slot in tear bar 32, etc. The nip station 28 is now in its open configuration and is no longer influencing the velocity of continuous paper form 16 as it passes printer station 18. Only the paper tractor feed 12 operates to lower continuous paper form 16 until its first line is properly positioned and ready to be printed.

It should be noted that when the nip station is in the closed configuration, the rollers 22, 24 provide tension on and sandwich continuous paper form 16 as it passes. When the nip station is in the open configuration, drive roller 22 and idler rollers 24 are no longer in contact; idler rollers 24 and idler shaft 26 are considered disengaged. The continuous paper form 16 therefore passes unassisted over drive roller 22, between rollers 22, 24, without making contact with idler rollers 24.

Figure 4:
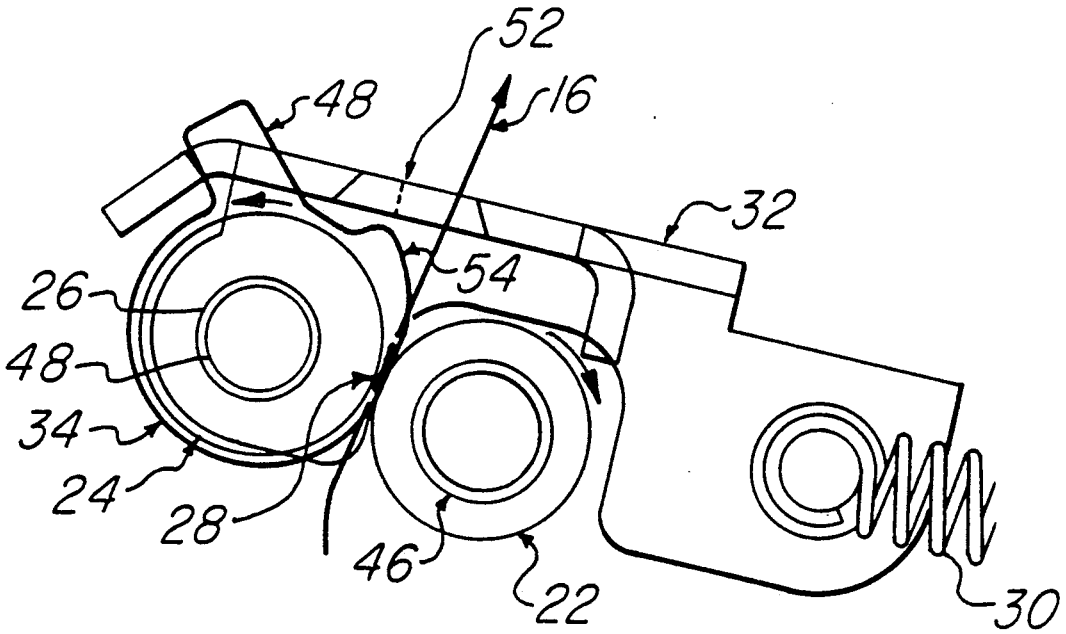
FIG. 4 is a close-up sectional side view of the preferred embodiment of the present invention with the idler roller assembly engaged with the drive roller.

FIG. 4 shows a closeup view of the preferred embodiment of the invention as seen in FIG. 1. Once continuous paper form 16 is positioned, forward print media motion commences. The movement of continuous paper form 16 rotates the cams 34 in a counter-clockwise direction, as viewed in FIG. 2, which allows extension springs 30 to re-establish tension on idler shaft 26 and return idler rollers 24 to their original positions against drive roller 22, and thereby maintain tension on continuous paper form 16. Further rotation, due to bearing losses at each of idler rollers 24, positions cams 34 so that their cam lobes 54 do not contact the drive roller 22 or drive roller shaft 46 during forward print media movement. This positioning and orientation saves wear on the cams 34 and drive shaft 46.

It should be noted that the idler rollers 24 operate at a diameter slightly larger than the idler roller shaft bearing 48 so that the reverse and forward print media movement always tends to rotate the idler shaft 26 and therefore the cams 34 first, and then idler rollers 24 on the shaft 26. Additionally, generally there are a plurality of idler rollers 24 (although a single idler roller is possible) to ensure their cumulative rotational drag is always greater than the rotational drag from the idler shaft 26 and its bearings 48. It should be further noted that the rotational limits of cams 34 are determined by cam tab 50 and tear bar cam slot 42.

Figure 5:
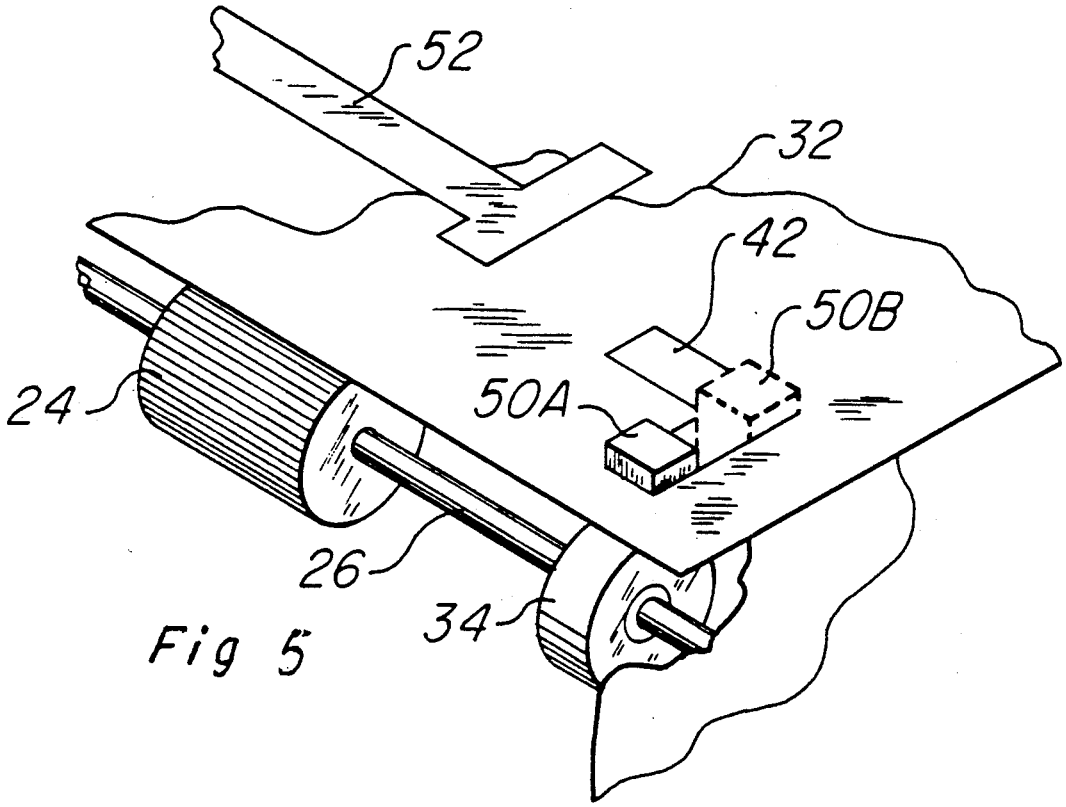
FIG. 5 is a sectional perspective view of the preferred embodiment of the present invention demonstrating the position of the present invention during forward and reverse print media movement.

FIG. 5 is a perspective view of the preferred embodiment of the present invention. Tear bar 32 is shown with two slots in it: a paper tear slot 52 where continuous paper form 16 emerges from the printer and tear bar tab slot 42.

During forward print media movement, cam tab 50 is in position 50A of tear bar tab slot 42, which prevents the cam 34 from rotating further. With cam tab 50 in position 50A, idler rollers 24 on idler shaft 26 abut drive roller 22 (not seen) because cam 34 is not in contact with drive roller 22 (see FIG. 4).

In FIG. 5, during reverse print media movement, on the other hand, cam tab 50 is in position 50B of tear bar tab slot 42 (shown by a dashed outline), which also prevents the cam 34 from rotating further in that direction. With cam tab 50 in position 50B, idler rollers 24 on idler shaft 26 are disengaged from, and do not contact, drive roller 22 (see FIG. 3).

While a specific embodiment of the invention has been shown and described, it should be understood that numerous variations and alternate embodiments will occur to those skilled in the art. Accordingly, it is intended that the invention be limited only in terms of the appended claims.

We claim:

1. a printing apparatus for printing an image or plurality of images on a continuous-feed print media, comprising:

a print device for printing onto said print media;

a movement device for moving said print media past said print device;

a drive structure for moving said print media out of the printing apparatus after said print media has emerged from said print device;

a spring device;

a shaft structure;

a roller structure coupled to said shaft structure;

a cam structure coupled to said shaft structure and rotatable thereabout;

a tear structure coupled to said shaft structure and positioned such that a predetermined portion of said print media may be removed from the printing apparatus after passing through said tear structure;

an idler assembly device positioned so that its longitudinal axis is parallel to that of said drive structure, to assist said drive structure in moving said print media by longitudinally engaging said drive structure, said idler assemble device comprising said cam, shaft, roller, and tear structures;

a mounting structure proximately located to said idler assembly device;

said idler assembly device held in longitudinal engagement with said drive structure by said spring device; one end of said spring device is coupled to said idler assembly device and the other end of said spring device is coupled to said mounting structure and said cam structure further engages with said tear structure to thereby disengage said idler assembly device from said drive structure.

2. The printing apparatus of claim 1, wherein said movement device is a tractor feed.

3. The printing apparatus of claim 2, wherein said tractor feed contains sprocket teeth to engage the edge of said print media.

4. The printing apparatus of claim 1, wherein said roller structure comprises a plurality of rollers.

5. The printing apparatus of claim 1, wherein said cam structure comprises at least one cam.

6. The printing apparatus of claim 1, wherein said cam structure comprises two cams.

7. The printing apparatus of claim 6, wherein one of said two cams is positioned toward one end of said shaft structure, and the other of said two cams is positioned toward the other end of said shaft structure.

8. The printing apparatus of claim 1, wherein both said drive structure and roller structure rotate about their respective longitudinal axes.

9. The printing apparatus of claim 8, wherein said drive structure and roller structure rotate in opposite directions.

10. The printing apparatus of claim 1, wherein said movement devices moves said print media in either the forward or reverse direction.

11. The printing apparatus of claim 10, wherein said cam structure disengages said idler assembly device from said drive structure during reverse movement of said print media.

12. The printing apparatus of claim 1, wherein said cam structure has a tab.

13. The printing apparatus of claim 12, wherein said cam structure tab engages with said tear structure to disengage said idler assembly device from said drive structure.

14. The printing apparatus of claim 5, wherein at least one of said cams has a tab.

15. The printing apparatus of claim 14, where said at least one cam structure tab engages with said tear structure to disengage said idler assembly device from said drive structure.

16. The printing apparatus of claim 1, said tear structure has at least one stop device proximately located to the cam structure and adapted to engage said cam structure.

17. The printing apparatus of claim 16, wherein said cam structure has at least one tab and said at least one tab engages said at least one stop feature.

18. The printing apparatus of claim 1, wherein said stop device is at least one slot in said tear structure.

19. The printing apparatus of claim 1, wherein said stop device is at least one protruding portion of said tear structure.

20. The printing apparatus of claim 1, wherein said stop device is at least one groove or hollow in said tear structure.

21. A printing device for printing an image or plurality of images on a continuous-feed print media, including a print station adapted to print onto said print media, comprising:

a movement system adapted to move said print media past said print station;

a drive device adapted to move said print media out of the printing device after said print media has emerged from said print station;

a spring structure;

a shaft structure;

a roller apparatus coupled to said shaft structure;

a cam structure carried on said shaft structure and adapted to rotate thereabout, said cam structure comprising at least one cam, said cam structure contains at least one tab arm on said at least one cam;

a stop device;

a tear frame structure coupled to said shaft structure and positioned such that a predetermined portion of said print media may be removed from the printing apparatus after passing through said tear frame structure, said tear frame structure coupled to said stop device;

an idler assembly device adapted to assist said drive structure in moving said print media by longitudinally engaging with said drive structure and positioned so that said idler assembly device's longitudinal axis is parallel to that of said drive device, said idler assembly device comprising said cam structure, shaft structure, roller apparatus, and tear frame structure;

a mounting structure proximately located to said idler assembly device;

said idler assembly device held in longitudinal engagement with said drive structure by said spring device; one end of said spring structure is coupled to said idler assembly device and the other end of said spring structure is coupled to said mounting structure; and said cam structure further adapted to engage with said tear frame structure to thereby disengage said idler assembly device from said drive device.

22. The printing device of claim 21, wherein said movement system is a tractor feed.

23. The printing device of claim 21, wherein said roller apparatus comprises a plurality of rollers.

24. The printing device of claim 21, wherein both said drive device and roller apparatus rotate about their respective longitudinal axes.

25. The printing device of claim 21, wherein said movement system is adapted to move said print media in either the forward or reverse direction.

26. The printing device of claim 25, wherein said cam structure disengages said idler assembly device from said drive device during reverse movement of said print media.

27. The printing device of claim 21, wherein said cam structure's at least one tab arm engages said tear frame structure's stop feature.

28. The printing device of claim 21, wherein said stop device is at least one slot in said tear frame structure.

29. The printing device of claim 21, wherein said stop device is at least one protruding portion of said tear frame structure.

30. The printing device of claim 21, wherein said stop device is at least one groove or hollow in said tear frame structure.

* * * * *